United States Patent [19]

Kato et al.

[11] Patent Number: 4,871,638

[45] Date of Patent: Oct. 3, 1989

[54] ELECTROPHOTOGRAPHIC PHOTOSENSITIVE MATERIAL WITH BINDER COMBINATION

[75] Inventors: Eiichi Kato; Kazuo Ishii; Ryosuke Itakura, all of Shizuoka, Japan

[73] Assignee: Fuji Photo Film Co., Ltd., Kanagawa, Japan

[21] Appl. No.: 165,949

[22] Filed: Mar. 9, 1988

[30] Foreign Application Priority Data

Mar. 9, 1987 [JP] Japan ..... 62-52186

[51] Int. Cl.[4] ..... G03G 5/087

[52] U.S. Cl. ..... 430/96

[58] Field of Search ..... 430/96

[56] References Cited

U.S. PATENT DOCUMENTS

| | | | |
|---|---|---|---|
| 3,881,925 | 5/1975 | Uchida et al. | 430/96 X |
| 3,929,480 | 12/1975 | Perlis et al. | 430/96 X |
| 4,435,493 | 3/1984 | de Putter et al. | 430/96 X |

FOREIGN PATENT DOCUMENTS

| | | | |
|---|---|---|---|
| 1497236 | 5/1969 | Fed. Rep. of Germany | 430/96 |
| 2537581 | 3/1976 | Fed. Rep. of Germany | 430/96 |
| 48-32379 | 10/1973 | Japan | 430/96 |
| 59-191049 | 10/1984 | Japan | 430/96 |

*Primary Examiner*—Roland E. Martin

*Attorney, Agent, or Firm*—Sughrue, Mion, Zinn, Macpeak, and Seas

[57] ABSTRACT

An electrophotographic photosensitive material comprising a support having provided thereon a photoconductive layer containing at least an inorganic photoconductive material and a binder, wherein said binder comprises at least resin (A) having a weight average molecular weight of from $1\times10^3$ to $1\times10^4$ and containing from 0.05 to 20% by weight a copolymer component having at least one acid group selected from —$PO_3H$, —COOH, —$SO_3H$, —OH, —SH, and

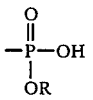

wherein R respresents a hydrocarbon group; and resin (B) having a weight average molecular weight of at least $3\times10^4$, said resin (B) not containing the aforesaid acid group nor a basic group.

11 Claims, No Drawings

ELECTROPHOTOGRAPHIC PHOTOSENSITIVE MATERIAL WITH BINDER COMBINATION

FIELD OF THE INVENTION

This invention relates to an electrophotographic photosensitive material, and more particularly to an electrophotographic photosensitive material having excellent electrostatic characteristics, humidity resistance and fastness.

BACKGROUND OF THE INVENTION

For obtaining desired characteristics, electrophotographic photosensitive materials having various constructions commensurate with the electrophotographic processes being employed.

Typical electrophotographic photosensitive materials include a photosensitive material comprising a support having formed thereon a photoconductive layer and a photosensitive material comprising a support having formed thereon a photosensitive layer and an insulating layer formed on the surface of the photosensitive layer. An electrophotographic photosensitive material comprising a support and at least one photoconductive layer is used for forming images by the most general electrophotographic process, that is, by electrostatic charging, image exposure, and development (and further, if necessary, image transferring).

Furthermore, a process of using an electrophotographic photosensitive material for directly producing a light-sensitive offset printing plate has been widely practiced.

A binder for forming the photoconductive layer of an electro-photographic photosensitive material is required to have various electrostatic characteristics. The binder should be excellent in film-forming property. The binder should adequately disperse therein photoconductive powders. The photoconductive layer formed using the binder should have good adhesive property with respect to the base material, should be excellent in static charging characteristic, show low dark decay, show large light decay, and show low pre-exposure fatigue, and further stably retain these properties even though humidity may vary at photographing. Moreover, the binder is required to have excellent photographic properties.

As conventionally known resins, there are silicone resins as described in Japanese Patent Publication No. 6670/59, styrene-butadiene resins as described in Japanese Patent Publication No. 1960/60, alkyd resins, maleic acid resins, polyamide resins as described in Japanese Patent Publication No. 11219/60, vinyl acetate resins as described in Japanese Patent Publication No. 2425/66, vinyl acetate copolymer resins as described in Japanese Patent Publication No. 2426/66, acryl resins as described in Japanese Patent Publication No. 11216/60, acrylic acid ester copolymers as described in Japanese Patent Publication Nos. 11219/60, 8510/61, and 13946/66, etc.

However, the electrophotographic photosensitive materials using these resins have the following problems. That is, (1) the affinity with photoconductive powders is deficient and the coating composition containing the resin is poor in dispersibility, (2) the photoconductive layer formed using the resin is low in static-charging property, (3) the image portion of the copy formed has poor in quality (in particular, dot reproducibility and resolving power), (4) the images formed are liable to be influenced by the environment (e.g., high-temperature and high-humidity condition or low-temperature and low-humidity condition) at the formation of copies, and (5) the film strength of the photosensitive layer and the adhesivity of the photosensitive layer are insufficient and hence if the photosensitive material is used, in particular, for producing an offset master, separation, etc., of the photosensitive layer occur to make it impossible to make a large number of prints.

Various methods for improving the electrostatic characteristics of photoconductive layers have been proposed. For example, Japanese Patent Publication Nos. 6878/67 and 3073/70 disclose a method of incorporating a compound having a carboxy group or nitro group on the aromatic ring or furan ring, or incorporating an anhydride of a dicarboxylic acid. However, even the electrophotographic photosensitive material improved by the aforesaid method remains insufficient in the electrostatic characteristics, and electrophotographic photosensitive materials having, in particular, excellent light decay characteristics have not yet been obtained even by the aforesaid method.

As one approach for improving the deficiency in sensitivity of the electrophotographic photosensitive material, a method of adding a large amount of sensitizing dye(s) to the photoconductive layer has hitherto been employed. However, the electrophotographic photosensitive materials prepared by employing the aforesaid method have problems. For example, the whiteness is greatly reduced to reduce the quality as recording materials and, as the case may be, the photosensitive materials cause deterioration of dark decay, whereby sufficient images are not obtained.

As another approach, a method involving controlling the average molecular weight of the binder resin used in the photoconductive layer is disclosed in Japanese Patent Application (OPI) No. 10254/85 (the term "OPI" as used herein indicates an "unexamined published Japanese patent application"). That is, there is described a technique of improving the electrophotographic characteristics (in particular, good repeated reproducibility as PPC photosensitive materials), humidity resistance, etc., by using an acryl resin having an acid value of from 4 to 50 and an average molecular weight of from $1\times10^3$ to $1\times10^4$ in combination with an acryl resin having an acid value of from 4 to 50 and an average molecular weight of from $1\times10^4$ to $2\times10^5$.

Furthermore, earnest investigations in photosensitive plates for making lithographic printing plates using electrophotographic photosensitive material have been made and as binder resins for photoconductive layers using both the electrostatic characteristics as electrophotographic photosensitive material and the printing characteristics as photosensitive plate for making the printing plate it is known that certain materials have the effect of improving the desensitization for photoconductive layers. That is, there are known, for example, a system of using a resin having a molecular weight of from $1.8\times10^4$ to $1\times10^5$ and a glass transition point (Tg) of from 10° C. to 80° C. prepared by copolymerizing a (meth)acrylate type monomer and other monomer in the presence of fumaric acid and a copolymer composed of a (meth)acrylate type monomer and a monomer other than fumaric acid as described in Japanese Patent Publication No. 31011/75, a system of using a ternary copolymer containing a (meth)acrylic acid ester having a substituent which has a carboxylic acid group at 7 atoms apart from the ester bond as described in Japanese Patent Application (OPI) No. 54027/78, a system of using a quaternary or pentamerous copolymer containing acrylic acid and hydroxyethyl (meth)acrylate as described in Japanese Patent Application (OPI) No. 202544/82, and a system of using a ternary copolymer containing a (meth)acrylic acid ester having an alkyl group of from 6 to 12 carbon atoms as a substituent and a vinyl monomer having a carboxylic acid as described in Japanese Patent Application (OPI) No. 68046/83.

However, even in the case of using the aforesaid resins which are said to have the effects of improving electrostatic characteristics, humidity resisting property, and durability, there are problems in electrostatic characteristics such as, in particular, electrostatic charging property, dark reduction retentivity, and photosensitivity and the smoothness of photoconductive layers and thus the use of these resins is yet insufficient for practical use.

Also, in the actual evaluation of binder resins which are developed for electrophotographic photosensitive plates for making lithographic printing plates, there are problems in the aforesaid electrostatic characteristics and background stains in prints.

SUMMARY OF THE INVENTION

This invention has been made with the object of overcoming the above-described problems of conventional electrophotographic photosensitive materials.

The object of this invention is, therefore, to provide an electrophotographic photosensitive material of good image quality having improved electrophotographic characteristics (in particular, dark electrostatic charge retentivity and photosensitivity) and capable of reproducing copied images faithful to the original image. Another object of this invention is to provide an electrophotographic photosensitive material giving clear and good images even though the ambient environment, such as heat and humidity, may be varied at the time of formation of copies.

Still another object of this invention is to provide an electrophotographic photosensitive plate for lithographic printing having excellent electrostatic characteristics (in particular, dark charge retentivity and photosensitivity), capable of reproducing copied images faithful to the original, and forming neither overall background stains nor spotlike background stains in prints.

The inventors have discovered that the aforesaid objects can be attained by an electrophotographic photosensitive material having a photoconductive layer containing at least an inorganic photoconductive material and a binder, wherein said binder comprises at least resin (A) and resin (B) shown below:

(i) Resin (A):

a resin having a weight average molecular weight of from $1\times10^3$ to $1\times10^4$ and containing from 0.05 to 20% by weight of a copolymer component having at least one acid group selected from $—PO_3H_2$, —COOH, $—SO_3H$, —OH, —SH, and

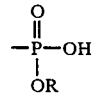

groups (wherein R represents a hydrocarbon group);

(ii) Resin (B):

a resin having a weight average molecular weight of at least $3\times10^4$ and not containing the aforesaid acid group nor a basic group.

DETAILED DESCRIPTION OF THE INVENTION

The present invention is described hereinafter in detail.

In resin (A) described above, R preferably represents an alkyl group having from 1 to 12 carbon atoms, which may be substituted, (e.g., a methyl group, an ethyl group, a propyl group, a butyl group, a hexyl group, an octyl group, a decyl group, a dodecyl group, a 2-chloroethyl group, a 2-methoxyethyl group, a 2-ethoxyethyl group, and a 3-methoxypropyl group), an aralkyl group having from 7 to 12 carbon atoms, which may be substituted, (e.g., a benzyl group, a phenethyl group, a chlorobenzyl group, a methoxybenzyl group, and a methylbenzyl group), an alicyclic group having from 5 to 8 carbon atoms (e.g., a cyclopentyl group and a cyclohexyl group), or an aryl group (e.g., a phenyl group, a tolyl group, a xylyl group, a mesityl group, a naphthyl group, a chlorophenyl group, and a methoxyphenyl group).

The binder resin for use in this invention is composed of a low molecular weight resin (A) containing the above-described acid group and a high molecular weight resin (B) containing neither an acid group as described above nor a basic group.

Preferred acid groups contained in the resin (A) described above are $—PO_3H$, —COOH, and/or $—SO_3H$ groups.

The ratio of the copolymer component of resin (A) containing the acid group is from 0.05 to 20% by weight, and preferably from 0.5 to 10% by weight based on the weight of the resin (A). The weight average molecular weight of the resin (A) is from $1\times10^3$ to $1\times10^4$, and preferably from $3\times10^3$ to $9\times10^3$.

The glass transition point of resin (A) is preferably from −10° C. to 100° C., and more preferably from −5° C. to 80° C.

Resin (B) is a resin having a weight average molecular weight of at least $3\times10^4$, and preferably from $5\times10^4$ to $5\times10^5$ and containing neither the aforesaid acid group nor a basic group.

The glass transition point of resin (B) is in the range of from 0° C. to 120° C., and preferably from 10° C. to 80° C.

In this invention, since the covering power of the surface of an inorganic photoconductive material is improved by the adsorption of the acid group contained in the resin (A) onto the stoichiometric defects of the inorganic photoconductive material and, further, the resin (A) has a low molecular weight, the trap of the photoconductive material is compensated and the humidity characteristics thereof are improved. Further, the photoconductive material is sufficiently dispersed to restrain the coagulation of the photoconductive material. Furthermore, the resin (B) gives sufficient mechanical strength, property of the photoconductive material which would be insufficient if resin (A) were employed alone.

If the content of the acid group in the resin (A) is less than 0.05% by weight, the initial potential of the photoconductive layer is low and hence a sufficient image density cannot be obtained. On the other hand, if the content of the acid group is higher than 20% by weight, the dispersibility of the conductive material is lowered, the smoothness of the photoconductive layer and the high-humidity characteristics of the electrophotographic characteristics are reduced. In addition, staining of the background in the case of using the electrophotographic photosensitive material as an offset master increases.

On the other hand, if resin (B) were to contain the acid group as in resin (A), the dispersibility of the photoconductive material would be reduced, whereby coagulations or precipitations form in the coated layer. Even if a coated layer is formed, the electrostatic characteristics of the photoconductive layer formed would be greatly reduced, and also the smoothness of the surface of the electrophotographic photosensitive material would be decreased thereby reducing the strength to mechanical friction, etc.

When an electrophotographic photosensitive material having rough surface smoothness of the photoconductive layer is used as an electrophotographic photosensitive plate for printing plate, the dispersion state of zinc oxide particles as photoconductive material in the binder resin is insufficient and thus the photoconductive layer is formed in a state containing coagulations, whereby a uniform hydrophilic property is not sufficiently imparted onto the non-image portion even in the case of applying thereto an oil-desensitizing treatment using an oil-desensitizing solution to cause attaching of printing ink to the background portion at printing, which results in causing background staining at the non-image portions of prints.

Furthermore, when the low molecular weight resin (A) of this invention is used alone as the binder resin for the photoconductive layer, the photoconductive layer formed has good surface smoothness and the electrostatic characteristics and also images having no background staining are obtained since the adsorption of the photoconductive material and the binder resin is sufficient to coat the surface of the photoconductive particles with the binder resin. However, the film strength of the photoconductive layer is insufficient and thus a sufficient durability of the layer is not obtained.

In only the case of using the resins of this invention, the interaction of adsorption and coating between an inorganic photoconductive material and the binder resins is properly performed and also the film strength of the photoconductive layer is high.

As the resin (A), any resin having the above-described properties can be used in this invention. Examples thereof include a polyester resin, a modified epoxy resin, a silicone resin, a polycarbonate resin, a vinyl alkanoate resin, a modified polyamide resin, a phenol resin, an aliphatic acid-modified alkyd resin, an acryl resin, etc.

More preferred examples of resin (A) are (meth)acryl type copolymers containing at least 30% by weight of a monomer represented by the following formula (I) as the copolymer component:

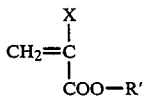

(I)

wherein X represents a hydrogen atom, a halogen atom (e.g., a chlorine atom or a bromine atom), a cyano group or an alkyl group having from 1 to 4 carbon atoms and R′ represents a substituted or unsubstituted alkyl group having from 1 to 18 carbon atoms (e.g., a methyl group, an ethyl group, a propyl group, a butyl group, a pentyl group, a hexyl group, an octyl group, a decyl group, a dodecyl group, a tridecyl group, a tetradecyl group, a 2-methoxyethyl group, and a 2-ethoxyethyl group), a substituted or unsubstituted alkenyl group having from 2 to 18 carbon atoms (e.g., a vinyl group, an allyl group, an isopropenyl group, a butenyl group, a hexenyl group, a heptenyl group, and an octenyl group), a substituted or unsubstituted aralkyl group having from 7 to 12 carbon atoms (e.g., a benzyl group, a phenetyl group, a methoxybenzyl group, an ethoxybenzyl group, and a methylbenzyl group), a substituted or unsubstituted cycloalkyl group having from 5 to 8 carbon atoms (e.g., cyclopentyl group, a cyclohexyl group, and a cycloheptyl group), or a substituted or unsubstituted aryl group (e.g., a phenyl group, a tolyl group, a xylyl group, a mesityl group, a naphthyl group, a methoxyphenyl group, an ethoxyphenyl group, a chlorophenyl group, and dichlorophenyl group).

The term "copolymer component having the acid group" as used herein includes any vinyl type compounds having the acid group capable of copolymerizing with the monomer represented by formula (I) described above. These vinyl type compounds are described, for example, in *Kobunshi (High Molecular) Data Handbook*", edited by High Molecular Society, published by Baihukan, 1986 and incorporated herein by reference. Preferred examples of such compounds include acrylic acid, α- and/or β-substituted acrylic acids (e.g., α-acetoxyacrylic acid, α-acetoxymethylacrylic acid, α-(2-amino)methylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-β-methoxyacrylic acid, and α,β-di-chloroacrylic acid), methacrylic acid, itaconic acid, itaconic acid half esters, itaconic acid half amides, crotonic acid, 2-alkenylcarboxylic acids (e.g., 2-pentenic acid, 2-methyl-2-hexenic acid, 2-octenic acid, 4-methyl-2-hexenic acid, 4-ethyl-2-octenic acid), maleic acid, maleic acid half esters, maleic acid halide amides, vinylbenzenecarboxylic acid, vinylbenzenesulfonic acid, vinylsulfonic acid, vinylphosphonic acid, half esters derivatives of the vinyl group or the allyl group of dicarboxylic acids, and ester derivatives or amide derivatives of these carboxylic acids or sulfonic acids having the aforesaid acid group in the substituent.

Furthermore, the resin (A) for use in this invention may further contain another monomer as a copolymer component together with the aforesaid monomer of formula (I) and the monomer having the acid group.

Examples of such monomers which can be used for resin (A) are α-olefins, alkanoic acid vinyl or allyl esters, acrylonitrile, methacrylonitrile, vinyl ethers, acrylamides, methacrylamides, styrenes, and heterocyclic vinyls (e.g., vinylpyrrolidone, vinylpyridine, vinylimidazole, vinylthiophene, vinylimidazoline, vinylpyrazole, vinyl dioxane, vinylquinoline, vinylthiazole, and vinyloxazine, etc.).

Resin (B) for use in this invention is a resin having a weight average molecular weight of at least $3\times10^4$ and containing neither the aforesaid acid group nor a basic group. The resin (B) preferably has a glass transition point of from 0° C. to 120° C. As the resin (B), any resins which are generally used as binder resins for electrophotographic photosensitive materials can be used and they may be used solely or as a combination of more than one. These resins are described in, for example, Harumi Miyahara and Hidehiko Takei, *Imaging*, No. 8, 9–12 (1978) and Ryuji Kurita and Jiro Ishiwatari, *Kobunshi* (*High Molecule*), 17, 278–284 (1968).

Specific examples of resin (B) for use in this invention are olefin polymers and copolymers, vinyl chloride copolymers, vinylidene chloride copolymers, vinyl alkanoate polymers and copolymers, allyl alkanoate polymers and copolymers, styrene polymers and copolymers, styrene derivative polymers and copolymers, butadiene-styrene copolymers, isoprene-styrene copolymers, butadiene-unsaturated carboxylic acid ester copolymers, acrylonitrile copolymers, methacrylonitrile copolymers, alkylvinyl ether copolymers, acrylic acid ester polymers and copolymers, methacrylic acid ester polymers and copolymers, styrene-acrylic acid ester copolymers, styrene-methacrylic acid ester copolymers, itaconic acid ester polymers and copolymers, maleic anhydride copolymers, acrylamide copolymers, methacrylamide copolymers, hydroxy group-modified silicone resins, polycarbonate resins, ketone resins, amide resins, hydroxy group- or carboxy group-modified polyester resins, butyral resins, polyvinylacetal resins, cyclized rubber-methacrylic acid ester copolymers, copolymers having a heterocyclic ring including rings containing no nitrogen atom (examples of the heterocyclic ring are a furan ring, a tetrahydrofuran ring, a thiophene ring, a dioxane ring, a dioxolan ring, a lactone ring, a benzofuran ring, a benzothiophene ring, and a 1,3-dioxetane ring), and epoxy resins.

More preferably, as the copolymer component, there are methacrylic copolymers and polymers containing at least 30% by weight of the methacrylic acid ester monomer shown by formula (I) described above. Specific examples of the preferred methacrylic acid ester monomer shown by formula (I) are those described hereinbefore.

Furthermore, the component which is copolymerized with the aforesaid methacrylic acid ester may be a monomer other than the monomer shown by formula (I), such as α-olefins, alkanoic acid vinyl esters, alkanoic acid allyl esters, acrylonitrile, methacrylonitrile, vinyl ethers, acrylamides, methacrylamides, styrenes, heterocyclic vinyl compounds (e.g., a 5- to 7-membered heterocyclic ring having from 1 to 3 non-metallic atoms other than a nitrogen atom, such as oxygen atoms and sulfur atoms, specific examples of heterocyclic vinyl compounds including vinylthiophene, vinyldioxane, vinylfuran, etc.). Preferred examples of the monomer are alkanoic acid vinyl or allyl esters having from 1 to 3 carbon atoms, acrylonitrile, methacrylonitrile, styrene and styrene derivatives (e.g., vinyltoluene, butylstyrene, methoxystyrene, chlorostyrene, dichlorostyrene, bromostyrene, and ethoxystyrene).

On the other hand, the basic group which is not contained in the resin (B) used in the present invention includes, for example, a substituted or unsubstituted amino group and a substituted or unsubstituted heterocyclic group containing nitrogen atom(s).

The compounding ratio of the resin (A) and the resin (B) for use in this invention varies depending upon the kind, particle sizes, and the surface state of the inorganic photoconductive material, but is generally 5 to 80/95 to 20, and preferably 15 to 60/85 to 40 (weight ratio) as (A)/(B).

As the inorganic photoconductive material being used in this invention, there are zinc oxide, titanium oxide, zinc sulfide, cadmium sulfide, cadmium carbonate, zinc selenide, cadmium selenide, tellurium selenide, lead sulfide, etc.

In this invention, if necessary, various kinds of dyes can be used together with the inorganic photoconductive material as spectral sensitizers, and examples of such spectral sensitizers are carbonium type dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (which may contain metals) as described, for example, in Harumi Miyamoto and Hidehiko Takei, *Imaging*, No. 8, 12 (1973); C. J. Yound, et al, *RCA Review*, 15, 469 (1954), Koohei Kiyota, *Denkitsushin Gakkai Ronbun Shi* (*Journal of Telecommunication Society*), J 63-C, No. 2, 97 (1980); Yuuji Harasaki, *Kogyo Kagaku Zasshi* (*Journal of Industrial Chemistry*), 66, 78 and 188 (1963); and Tadaaki Tani, *Journal of The Society of Photographic Science and Technology of Japan*, 35, 208 (1972).

More practically, carbonium type dyes, triphenylmethane type dyes, xanthene type dyes, and phthalein type dyes, which are used for the aforesaid purpose, are those described in Japanese Patent Publication No. 452/76, Japanese Patent Application (OPI) Nos. 90334/75, 114227/75, 39130/78, 82353/78, 16456/82, U.S. Pat. Nos. 3,052,540, 4,054,450, etc.

The polymethine dyes such as oxonol dyes, merocyanine dyes, cyanine dyes, and rhodacyanine dyes, which can be used in this invention, are described in F. M. Harmmer, *The Cyanine Dyes and Related Compounds*, etc. Specific examples of these dyes are described in U.S. Pat. Nos. 3,047,384, 3,110,591, 3,121,008, 3,125,447, 3,128,179, 3,132,942, 3,622,317, British Pat. Nos. 1,226,892, 1,309,274, 1,405,898, Japanese Patent Publication Nos. 7814/73, 18892/80, etc.

Moreover, specific examples of polymethine dyes spectrally sensitizing the near infrared to infrared regions of wavelength longer than 700 nm are described in Japanese Patent Application (OPI) Nos. 840/72, 44180/72, 5034/74, 5122/74, 46245/82, 35141/81, 157254/82, 26044/86, 27551/86, Japanese Patent Publication No. 41061/76, U.S. Pat. Nos. 3,619,154, 4,175,956, and *Research Disclosure*, No. 216, 117–118 (1982).

For the electrophotographic photosensitive materials of this invention, various sensitizing dyes may be used as a combination thereof and further, if necessary, other various additives for electrophotographic photosensitive layers, such as chemical sensitizers, etc., can be used. Examples of these additives are electron acceptive compounds (e.g., halogens, benzoquinones, chloranyl, acid anhydrides, and organic carboxylic acids) described in aforesaid Imaging, No. 8, 12 (1973) and polyarylalkane compounds, hindered phenol compounds, p-phenylenediamine compounds, etc., as described in Hiroshi Komon, *Recent Development and Practical Use of Photoconductive Materials and Photosensitive Materials*, Chapters 4–6, published by Nippon Kagaku Jooho, K.K., 1986.

There is no particular restriction on the addition amounts of these additives but the addition amounts thereof are usually from 0.0001 to 2.0 parts by weight based on 100 parts by weight of the photoconductive material.

The thickness of the photoconductive layer is from 1 μm to 100 μm, and particularly preferably from 10 μm to 50 μm.

Also, when the photoconductive layer is used as a charge generating layer for a laminate type photosensitive material composed of a charge generating layer and a charge transfer layer, the thickness of the charge generating layer is preferably from 0.01 μm to 1 μm, and particularly preferably from 0.05 μm to 0.5 μm.

As the case may be, an insulating layer is formed on the photosensitive material for mainly the protection of the photographic material and improving the durability and dark decay characteristics thereof. In this case, the thickness of the insulating layer is relatively thin, but in the case of using the photosensitive material for a specific electrophotographic process, an insulating layer having a relatively thick thickness is formed thereon. In the latter case, the thickness of the insulating layer is preferably from 5 μm to 70 μm, and particularly preferably from 10 μm to 50 μm.

The charge transfer material for the aforesaid laminate type electrophotographic photosensitive material includes polyvinylcarbazole type dyes, oxazole type dyes, pyrazoline type dyes, triphenylmethane type dyes, etc. The thickness of the charge transfer layer is from 5 μm to 40 μm, and preferably from 10 μm to 30 μm.

Typical examples of a binder for forming the aforesaid insulating layer and/or charge transfer layer are such thermoplastic resins and thermosetting resins as polystyrene resins, polyester resins, cellulose resins, polyether resins, vinyl chloride resins, vinyl acetate resins, vinyl chloride-vinyl acetate copolymer resins, polyacryl resins, polyolefin resins, urethane resins, epoxy resins, melamine resins, and silicone resins.

The photoconductive layer in this invention can be formed on a support conventionally known in the field of the art. In general, it is preferred that the support for the electrophotographic photosensitive material is electrically conductive. Examples of the conductive support include a metal, a base material such as paper, plastic sheet, etc., subjected to a conductive treatment by the impregnation of a low resistant material, a base material the back surface (i.e., the surface opposite to the surface of carrying a photosensitive layer) of which is rendered conductive and is further coated with at least one layer for preventing the occurrence of curling, etc., the aforesaid support further having a water resisting adhesive layer on the surface thereof, the aforesaid support having at least one pre-coat on the surface layer thereof, a paper laminated with a conductive plastic sheet having a vapor deposited layer of aluminum, etc.

Preferred examples of the conductive base plates materials rendered conductive are described in Yukio Sakamoto, *Electrophotography,* No. 1, 2–11 (1975), Hiroyuki Moriga, *Introduction to Chemistry of Specific Papers,* published by Kobunshi Kanko Kai, 1975, M. F. Hoover, *Journal of Macromolecular Sci. Chem.,* A-4 (6), 1327–1417 (1970), etc.

The following examples serve to illustrate the present invention without limiting, however, the scope of this invention. Unless otherwise specified, all parts, percents and proportions are by weight.

SYNTHESIS EXAMPLE 1

After heating a mixture of 95 g of ethyl methacrylate, 5 g of acrylic acid, and 200 g of toluene to 90° C. in a nitrogen gas stream, 6 g of 2,2'-azobis(2,4-dimethylvaleronitrile) was added to the mixture and this mixture was reacted for 10 hours. The copolymer (A)-1 thus obtained had a weight average molecular weight of 7,800 and a glass transition point of 45° C.

SYNTHESIS EXAMPLE 2

After heating a mixture of 100 g of ethyl methacrylate and 200 g of toluene to 70° C. in a nitrogen gas stream, 0.5 g of azobisisobutyronitrile was added to the mixture and the mixture was permitted to react for 10 hours. The copolymer (B)-1 thus obtained had a weight average molecular weight of 63,000 and a glass transition point of 48° C.

SYNTHESIS EXAMPLE 3

After heating a mixture of 94 g of ethyl methacrylate, 6 g of acrylic acid, and 200 g of toluene to 70° C. in a nitrogen gas stream, 0.5 g of azobisisobutyronitrile was added to the mixture followed by reacting for 10 hours. The copolymer (B)-2 thus obtained had a weight average molecular weight of 60,000 and a glass transition point of 50° C.

SYNTHESIS EXAMPLE 4

After heating a mixture of 97 g of ethyl methacrylate, 3 g of acrylic acid, and 200 g of toluene to 70° C. in a nitrogen gas stream, 0.5 g of azobisisobutyronitrile was added to the mixture followed by reacting for 10 hours. The copolymer (B)-3 thus obtained had a weight average molecular weight of 61,000 and a glass transition point of 50° C.

EXAMPLE 1

A mixture of 10 g (as solid component) of the resin (A)-1 produced in Synthesis Example 1, 30 g (as solid component) of the resin (B)-1 produced in Synthesis Example 2, 200 g of zinc oxide, 0.05 g of rose bengale, and 300 g of toluene was dispersed in a ball mill for 2 hours to provide a coating composition for a photosensitive layer. The coating composition was coated on a paper subjected to a conductive treatment by means of a wire bar so that the dry coated amount became 22 g/m$^2$. The coated paper was dried at 110° C. for one minute, and then allowed to stand for 24 hours in the dark under the condition of 20° C. and 65% RH. Thus, an electrophotographic photosensitive material was obtained.

COMPARATIVE EXAMPLE A

By following the same procedure as Example 1 except that 40 g (as solid content) of the resin (A)-1 only was used as the binder resin in place of the combination of resin (A)-1 and resin (B)-1, electrophotographic photosensitive material A was prepared.

COMPARATIVE EXAMPLE B

By following the same procedure as Example 1 except that 40 g (as solid content) of the resin (B)-2 only prepared in Synthesis Example 3 was used as the binder resin, electrophotographic photosensitive material B was prepared.

COMPARATIVE EXAMPLE C

By following the same procedure as Example 1 except that 40 g (as solid content) of the resin (B)-3 only prepared in Synthesis Example 4 was used as the binder resin, electrophotographic photosensitive material C was prepared.

COMPARATIVE EXAMPLE D

By following the same procedure as Example 1 except that 10 g (as solid content) of the resin (A)-1 only prepared in Synthesis Example 1 and 30 g (as solid component) of the resin (B)-3 prepared in Synthesis Example 4 were used as the binder resin, electrophotographic photosensitive material D was prepared.

The film-surface property (smoothness of surface), the film strength, and the electrostatic characteristics of each of these electrophotographic photosensitive materials and also the photographic property thereof under the ambient conditions of 30° C. and 80% RH (relative humidity) were determined. Furthermore, each of the photosensitive materials was used as an offset master and the oil-desensitizing property (shown by the contact angle of the photosensitive layer with water after being oil-desensitized) of the photoconductive layer and the printing properties (background stain, printing durability, etc.) thereof were determined.

The photographic property and the printing properties were determined as follows. That is, the photosensitive material was imagewise exposed and developed using an automatic camera processor ELP 404V (trade name, product of Fuji Photo Film Co., Ltd.) and a developer (toner) ELP-T (trade name, product of Fuji Photo Film Co., Ltd.) to form images, the photoconductive layer thus developed was etched by an etching processor using an oil-desensizing solution ELP-E (trade name, product of Fuji Photo Film Co., Ltd.) to provide a lithographic printing plate, and the above-described properties were determined using the printing plate. Hamada Star Type 800OSX (trade name, product of Hamada Star K.K.) was used as the printing machine.

The results obtained are shown in Table 1 below.

The surface of each photosensitive material was repeatedly rubbed 1,000 times with an emery paper (fillet) of #1000 under a load of 50 g/cm$^2$ using a Heidon 14 type surface test machine (product of Shinji Kagaku K.K.). After removing powders formed by rubbing, the weight loss of the photosensitive material was measured, and the mechanical strength was determined based on the film remaining (%).

(*3): Electrostatic Characteristics:

After applying corona discharging of −6 KV onto the surface of each photosensitive material for 20 seconds using a paper analyzer (Paper Analyzer Type SP-428, trade name, made by Kawaguchi Denki K.K.) in a dark room kept at 20° C. and 65% RH, the photosensitive material was allowed to stand for 10 seconds and then the surface potential ($V_{10}$ in this case) was measured. Then, after allowing the photosensitive material to stand in the dark for 60 seconds, the surface potential $V_{70}$ was measured, whereby the retentivity of potential, i.e., the dark reduction retention [DRR (%)] of the photosensitive material after reducing the potential in the dark was obtained by $V_{70}/V_{10}\times 100$ (%).

Also, after charging the surface of each photoconductive layer at −400 volts by corona discharging, the surface of the photoconductive layer was irradiated by visible light of 2.0 lux, the time required to reduce the surface potential ($V_{10}$) to 1/10 thereof was measured, and the exposure amount $E_{1/10}$ (lux·sec) was calculated therefrom.

(*4): Property of Electrophotographic Image:

After allowing each photosensitive material to stand for a whole day and night under the ambient conditions of 20° C. and 65% RH or 30° C. and 80% RH, the photosensitive material was processed (imagewise exposure, development and fixing) under the above temperature and humidity conditions using an automatic camera processor ELP-404V (trade name, a product of Fuji Photo Film Co., Ltd.). The properties of the images electrophotographically obtained on the photosensitive material (fog and image quality) were evaluated with the eye, according to the following ranks:

A: Good image was obtained.

B: Slight background fog was observed.

(*5) Contact Angle with Water:

TABLE 1

| | | | Comparative | | |
|---|---|---|---|---|---|
| | | Example 1 | Example A | Example C | Example D |
| Smoothness of Photoconductive Layer *1 | (sec/cc) | 100 | 80 | 20 | 30 |
| Strength of Conductive Layer *2 | (%) | 95 | 60 | 90 | 85 |
| Electrostatic Characteristics *3 | | | | | |
| Vo | (−V) | 560 | 600 | 530 | 540 |
| DRR | (%) | 92 | 94 | 85 | 88 |
| $E_{1/10}$ | (lux·sec) | 8.0 | 8.5 | 7.0 | 8.3 |
| Photographic Property *4 | | | | | |
| I: at 20° C. and 65% RH | | A | A | A | A |
| II: at 30° C. and 80% RH | | A | A | B<br>Dm: *8<br>Unmeasurable<br>Fine lines<br>are broken | B<br>Dm:<br>Unmeasurable<br>Fine lines<br>are broken |
| Contact Angle with Water *5 | (degree) | 15 | 13 | 35 | 30 |
| Background Stain of Print *6 | | | | | |
| I: | | A | A | E | C |
| II: | | B | B | F | D |
| Printing Durability *7 | | More than 10,000 prints | 3,000 prints | Background stain is generated from the 1st print | Background stain is generated from the 1st print |

The terms shown in Table 1 were evaluated as follows.

(*1): Smoothness of Photoconductive Layer:

The smoothness (sec/cc) of each photosensitive material was measured using a Beck smoothness test machine (made by Kumagaya Riko K.K.) under a condition of air volume of 1 cc.

(*2): Mechanical Strength of Photoconductive Layer:

After oil-desensitizing the surface of each photoconductive layer by passing each of the photosensitive materials through an etching processor using an oil-desensitizing solution ELP-E (trade name, product of Fuji Photo Film Co., Ltd.), a water drop of 2 μ of distilled water was placed on the surface and the contact angle of the water drop formed was measured by means of a goniometer.

(*6) Background Stain of Print:

By processing each photosensitive material using an automatic camera processor ELP 404V (trade name, product of Fuji Photo Film Co., Ltd.), toner images were formed to provide a printing plate. The surface of the printing plate was desensitized as the case of (*3) described above, printing was applied on 500 sheets of wood free paper using the printing plate as offset master by means of an offset printing machine (Hamada Star Type 800SX, trade name, product of Hamada Star K.K.), and the background stain was evaluated by the eye on all the prints. The stain is defined as background stain I of print.

Background stain II of print was evaluated by the same manner as background stain I except that the desensitizing solution was diluted with five parts and the fountaining solution at printing was diluted with two parts. That is, the case of background stain II corresponds to the case of printing under severer condition than the case of background stain I.

The ranks used for evaluating the background stain were as follows:

A: Excellent (no stain)
B: Good
C: Slight spot-like stains were observed
D: Stains were fairly observed
E: Stains were markedly observed
F: Entire surface was stained so that the image area could not be distinguished from the background area (*7) Printing Durability:

Each photosensitive material was processed under the evaluation condition as the case of evaluating background stain I of print described above (*6) and the number of prints printed without forming stains at the non-image portions of the prints and without causing problems on the quality of the image portions thereof was taken as the index of printability (the larger the number of prints, the better the printing durability).

(*8) Dm (Image Density):

The maximum value was shown by the toner image density at the solid black portion of each printing plate (the density can be measured by a Macbeth reflection densitometer).

As shown in Table 1 above, it can be seen that the photosensitive material of this invention and comparison photosensitive material A are better in the smoothness and electrostatic characteristics of the photoconductive layer and also give prints having no background fog and clear images. This is assumed to be attributable to the binder resin which sufficiently adsorbs on the photoconductive particles and sufficiently coats the surface of the particles.

When these photosensitive materials are used as photosensitive plates for an offset master, the oil-desensitization by an oil-desensitizing solution sufficiently proceeds by the same reason as above, whereby the surface of the non-image portions is sufficiently rendered hydrophilic to such an extent that the contact angle of the non-image portion with water is less than 15°. When printing was practiced using these printing plates and the background stain of prints obtained was observed, no stain was observed. However, in the cases of the strength test and printing durability test of the photoconductive layer, the comparative photosensitive material A was insufficient in film strength and evidenced a serious problem in durability.

On the other hand, in the case of the resin which was used for making the comparative photosensitive material B, a coagulation state occurred to an extent of not enabling the preparation of the dispersion for forming a photoconductive layer. When the high molecular weight resin containing a reduced amount of acid component was used as the binder resin in the comparative photosensitive material C, the smoothness of the photosensitive layer surface of the electrophotographic photosensitive material was greatly reduced. This is considered to be attributable to the binder resin absorbing the photoconductor particles causing the photoconductive particles to coagulate with each other.

Furthermore, even in the case of the comparative photosensitive material D using the low molecular weight resin and the high molecular weight resin both containing an acid component, this material showed the same results as the case of the comparative photosensitive material C.

As demonstrated above, only the photosensitive material according to the present invention is excellent in all the points .of smoothness, film strength, electrostatic characteristics, and printability of the photoconductive layer.

EXAMPLES 2 TO 16

Copolymers shown in Table 2 were prepared as low molecular weight resin (A)-2 through (A)-16 by following the same procedure as the case of preparing the resin (A)-1 in Synthesis Example 1.

TABLE 2

| Example No. | Example of Resin (A) | Monomer Compositions (weight ratio) | Weight Average Molecular Weight ($\times 10^3$) |
|---|---|---|---|
| 2 | 2 | Ethyl methacrylate 94, Itaconic acid 6 | 7.9 |
| 3 | 3 | Ethyl methacrylate 95, $CH_2{=}CH$ \| $COO(CH_2)_2COOH$ | 7.7 |
| 4 | 4 | Ethyl methacrylate 92, $CH_2{=}C(CH_3)$ \| $COO(CH_2)_2OCO(CH_2)_3COOH$ | 7.6 |

TABLE 2-continued

| Example No. | Example of Resin (A) | Monomer Compositions (weight ratio) | | Weight Average Molecular Weight ($\times 10^3$) |
|---|---|---|---|---|
| 5 | 5 | Ethyl methacrylate 92, $CH_2{=}C(CH_3)CONH(CH_2)_{10}COOH$ | 8 | 7.8 |
| 6 | 6 | Ethyl methacrylate 95, $CH_2{=}C(CH_2COOCH_3)COOH$ | 5 | 8.0 |
| 7 | 7 | Ethyl methacrylate 95, $CH_2{=}CH{-}C_6H_4{-}COOH$ | 5 | 8.2 |
| 8 | 8 | Ethyl methacrylate 95, $CH_2{=}CH{-}CONH{-}C_6H_3(OH){-}COOH$ | 5 | 8.0 |
| 9 | 9 | Ethyl methacrylate 98, $CH_2{=}C(CH_3)COO(CH_2)_3SO_3Na$ | 2 | 7.6 |
| 10 | 10 | Ethyl methacrylate 99, $CH_2{=}C(CH_3)COO(CH_2)_2O{-}P(=O)(OH){-}OH$ | 1 | 7.8 |
| 11 | 11 | Ethyl methacrylate 98, $CH_2{=}CH{-}C_6H_4{-}SO_3Na$ | 2 | 8.0 |
| 12 | 12 | Ethyl methacrylate 95, $CH_2{=}CH{-}CH_2OCO(CH_2)_2COOH$ | 5 | 8.3 |
| 13 | 13 | Ethyl methacrylate 99, $CH_2{=}CH{-}C_6H_4{-}O{-}P(=O)(OH){-}OH$ | 1 | 7.7 |
| 14 | 14 | Ethyl methacrylate 98, $CH_2{=}CH{-}CONHCH_2C(CH_3)_2{-}SO_3H$ | 2 | 7.6 |
| 15 | 15 | Ethyl methacrylate 95, $CH_2{=}C(CH_3){-}CONHCH(CH_2COOH){-}COOH$ | 5 | 7.5 |
| 16 | 16 | Ethyl methacrylate 95, $CH_2{=}C(CH_3){-}COO(CH_2)_2OCO{-}C_6H_3(COOH){-}COOH$ | 5 | 7.9 |

By following the same procedure as described in Example 1 except that 10 g (as solid component) of each of the aforesaid resins and 30 g (as solid component) of the resin (B)-1 prepared in Synthesis Example 2 were used as the binder resin.

Then, the properties of each electrophotographic photosensitive material were measured by the same manner as Example 1. The smoothness and the film strength of each photosensitive material were almost the same as those of the sample in Example 1. The results obtained with regard to electrostatic characteristics and photographic properties are shown in Table 3 below.

TABLE 3

| Example No. | Example of Resin (A) | Vo (−V) | DRR % | $E_{1/10}$ (lux · sec) | Property of Image Obtained at 30° C. and 80% RH |
|---|---|---|---|---|---|
| 2 | 2 | 550 | 94 | 8.0 | Good Image |
| 3 | 3 | 550 | 92 | 7.5 | " |
| 4 | 4 | 565 | 95 | 7.0 | " |
| 5 | 5 | 555 | 93 | 8.0 | " |
| 6 | 6 | 550 | 91 | 8.5 | " |
| 7 | 7 | 560 | 95 | 8.0 | " |
| 8 | 8 | 565 | 93 | 7.5 | " |
| 9 | 9 | 550 | 92 | 8.5 | " |
| 10 | 10 | 545 | 94 | 8.0 | " |
| 11 | 11 | 550 | 89 | 8.0 | " |
| 12 | 12 | 545 | 90 | 8.5 | " |
| 13 | 13 | 555 | 94 | 7.5 | " |
| 14 | 14 | 555 | 96 | 8.5 | " |
| 15 | 15 | 540 | 96 | 9.0 | " |
| 16 | 16 | 540 | 95 | 8.0 | " |

As shown in the above table, each photosensitive material is excellent in electrostatic charging property, dark reduction retention, and photosensitivity and gives clear images without causing background stain even under severe conditions of high temperature and high humidity (i.e., 30° C., 80% RH).

EXAMPLE 17 AND COMPARATIVE EXAMPLE E

After heating a mixture of 48.5 g of ethyl methacrylate, 48.5 g of benzyl methacrylate, 3 g of methacrylic acid, and 200 g of toluene to 105° C. in nitrogen gas stream, 10 g of azobisisobutyronitrile was added to the mixture and the mixture was reacted for 8 hours.

The copolymer thus obtained had a weight average molecular weight of 6500 and a glass transition point of 40° C.

A mixture of 20 g (as solid component) of the copolymer thus obtained, 20 g of the resin (B)-1 prepared in Synthesis Example 2, 200 g of zinc oxide, 0.02 g of the heptamethinecyanine dye having the structure as shown below, 0.15 g of phthalic anhydride, and 300 g of toluene was dispersed in a ball mill for 2 hours to provide a coating composition for forming a photoconductive layer. Then, by following the same procedure as Example 1 using the aforesaid coating composition, an electrophotographic photosensitive material was prepared.

Cyanine Dye:

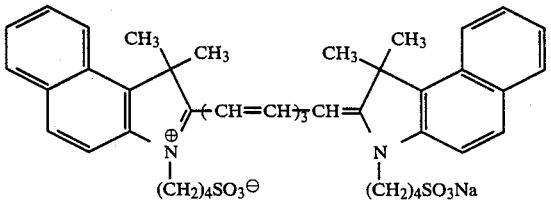

Comparative Photosensitive Material E:

After heating a mixture of 48.5 g of ethyl methacrylate, 48.5 g of benzyl methacrylate, 3 g of methacrylic acid, and 200 g of toluene to 70° C. in nitrogen gas stream, 10 g of azobisisobutyronitrile was added to the mixture and the mixture was permitted to react for 8 hours.

The copolymer obtained had a weight average molecular weight of 36,000 and a glass transition point of 54° C.

By following the same procedure as Example 17 except that 40 g (as solid component) of the aforesaid copolymer was used as the binder resin, a comparison photosensitive material E was prepared.

The electrostatic characteristics of each of these photosensitive materials were measured by the paper analyzer as in Example 1. In this case, however, a gallium-aluminum-arsenic semiconductor laser (oscillation wavelength 830 nm) was used as the light source.

The results obtained are shown in Table 4.

TABLE 4

| | Example 17 | Comparative Example E |
|---|---|---|
| Smoothness of Photoconductive Layer (sec/cc) | 110 | 95 |
| Strength of Photoconductive Layer (%) | 97 | 89 |
| Electrostatic Characteristics | | |
| Vo (−V) | 580 | 510 |
| DRR (%) | 90 | 50 |
| $E_{1/10}$ (erg/cm$^2$) | 53 | 56 |

As shown in Example 4, in the comparison photosensitive material E, the smoothness was poor and the dark reduction retention (DRR) was significantly lower (in appearance, $E_{1/10}$ was low and the photosensitivity was high as a result of low DRR). In the comparison sample, DRR is lower than that of the aforesaid comparison photosensitive material C, which shows that the conventional resins have the problem of being very easily influenced by the kind of a spectral sensitizing dye being used together. On the other hand, the binder resins in this invention provide an electrophotographic photosensitive material having very excellent charging property, dark reduction retention, and photosensitivity even when the chemical structure of the spectral sensitizing dye being used together with the resins is greatly varied.

EXAMPLES 18 TO 23

By following the same procedure as Example 1 except that a combination of the resin (A)-1 prepared in Synthesis Example 1 and the resin (B) shown in Table 5 was used at a 1/1 weight ratio, each of the electrophotographic photosensitive materials (A)-18 through (A)-23 was prepared. Then, the smoothness, film-strength, and electrostatic characteristics of each photosensitive material were measured by the same manner as Example 1.

The results obtained are shown in Table 5 below.

TABLE 5

| Example No. | Resin (B) | Weight Average Molecular Weight ($\times 10^4$) | Smoothness | Film Strength (%) | Vo (−V) | DRR (%) | $E_{1/10}$ (lux·sec) | Property of Image Obtained at 30° C. and 80% RH |
|---|---|---|---|---|---|---|---|---|
| 18 | Polyvinylbutyral | 8.5 | 105 | 93 | 560 | 90 | 8.0 | Good Image |
| 19 | Polyvinyl Acetate | 23 | 110 | 95 | 570 | 91 | 8.5 | " |
| 20 | Poly(styrene/ethyl methacrylate) (20/80) by weight ratio | 9.3 | 105 | 96 | 545 | 87 | 7.5 | " |
| 21 | Poly(styrene/butadiene) (25/75) by weight ratio | 14 | 95 | 96 | 550 | 88 | 8.5 | " |
| 22 | Poly(ethyl methacrylate) | 36 | 105 | 97 | 555 | 92 | 8.3 | " |
| 23 | Poly(n-butyl methacrylate) | 40 | 110 | 97 | 550 | 91 | 8.2 | " |

As shown in Table 5 above, it can be seen that the electrophotographic photosensitive materials of this invention thus prepared are excellent in the strength and electrostatic characteristics of the photoconductive layer and give clear images having no background stains even under high temperature and high humidity conditions (i.e., 30° C., 80% RH).

As demonstrated above, according to the present invention an electrophotographic photosensitive material excellent in smoothness, strength, electrostatic characteristics, and photographic property of the photoconductive layer, giving less background stain of prints, and also having excellent printing durability, is obtained.

Furthermore, the electrophotographic photosensitive materials of this invention show excellent smoothness and electrostatic characteristics of the photoconductive layer even in the case of using various kinds of sensitizing dyes.

While the invention has been described in detail and with reference to specific embodiments thereof, it will be apparent to one skilled in the art that various changes and modifications can be made therein without departing from the spirit and scope thereof.

What is claimed is:

1. An electro-photographic photosensitive material comprising a support having provided thereon a photoconductive layer containing at least an inorganic photoconductive material and a binder, wherein said binder comprises, in a mixture at least resin (A) having a weight average molecular weight of from $1\times10^3$ to $1\times10^4$ and containing from 0.05 to 20% by weight a copolymer component having at least one acid group selected from —$PO_3H$, —COOH, —$SO_3H$, —OH, —SH, and

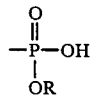

wherein R represents a hydrocarbon group; and resin (B) having a weight average molecular weight of at least $3\times10^4$, said resin (B) not containing the aforesaid acid group nor a basic group.

2. An electro-photographic photosensitive material as in claim 1, wherein R represents a substituent selected from the group consisting of a substituted or unsubstituted alkyl group having from 1 to 12 carbon atoms, a substituted or unsubstituted aralkyl group having from 7 to 12 carbon atoms, a substituted or unsubstituted cycloalkyl group having from 5 to 8 carbon atoms, and a substituted or unsubstituted aryl group.

3. An electrophotographic photosensitive material as in claim 2, wherein said substituted or unsubstituted alkyl, aralkyl, cycloalkyl and aryl group are selected from the group consisting of a methyl group, an ethyl group, a propyl group, a butyl group, a hexyl group, an octyl group, a decyl group, a dodecyl group, a 2-chloroethyl group, a 2-methoxyethyl group, a 2-ethoxyethyl group, a 3-methoxypropyl group, a benzyl group, a phenetyl group, a chlorobenzyl group, a methoxybenzyl group, a methylbenzyl group, a cyclopentyl group, a cyclohexyl group, a phenyl group, a tolyl group, a xylyl group, a mesityl group, a naphthyl group, a chlorophenyl group, an ethoxyphenyl group, a dichlorophenyl group and a methoxyphenyl group.

4. An electrophotographic photosensitive material as in claim 1, wherein resin (A) contains at least one acid group selected from the group consisting of —$PO_3H_2$, —COOH, and —$SO_3H$.

5. An electrophotographic photosensitive material as in claim 1, wherein the copolymer component if resin (A) containing the acid group is from 0.05 to 20% by weight based on the dry weight of resin (A).

6. An electrophotographic photosensitive material as in claim 1, wherein the copolymer component of resin (A) containing the acid group is from 0.5 to 10% by weight based on the dry weight of resin (A).

7. An electrophotographic photosensitive material as in claim 1, wherein the weight average molecular weight of resin (A) is from $3\times10^3$ to $9\times10^3$.

8. An electrophotographic photosensitive material as in claim 1, wherein the glass transition point of resin (A) is from −10° C. to 100° C.

9. An electrophotographic photosensitive material as in claim 1, wherein the the weight average molecular weight of resin (B) is from $5\times10^4$ to $5\times10^5$.

10. An electrophotographic photosensitive material as in claim 1, wherein the glass transition point of resin (B) is in the range of from 0° C. to 120° C.

11. An electrophotographic photosensitive material as in claim 1, wherein the compounding ratio, by dry weight, of resin (A) to resin (B) is 5 to 80/95 to 20.

* * * * *

UNITED STATES PATENT AND TRADEMARK OFFICE

CERTIFICATE OF CORRECTION

PATENT NO. : 4,871,638

DATED : October 3, 1989

INVENTOR(S) : Eiichi Kato, Kazuo Ishii and Ryosuke Itakura

It is certified that error appears in the above-identified patent and that said Letters Patent is hereby corrected as shown below:

In the Abstract, line 8; column 4, line 33; and column 19, line 49, delete "$PO_3H$" and insert -- $-PO_3H_2$ --.

Signed and Sealed this

Nineteenth Day of February, 1991

*Attest:*

HARRY F. MANBECK, JR.

*Attesting Officer*

*Commissioner of Patents and Trademarks*